US005308302A

United States Patent [19]

Miller

[11] Patent Number: 5,308,302

[45] Date of Patent: May 3, 1994

[54] EXERCISE MACHINE FOR SEATED OPERATOR

[76] Inventor: Samuel Miller, 2724 N. Garden Dr., Apt. 302, Lake Worth, Fla. 33461

[21] Appl. No.: 143,664

[22] Filed: Nov. 1, 1993

[51] Int. Cl.[5] ..... A63B 21/00; A63B 22/06

[52] U.S. Cl. ..... 482/60; 482/79; 482/904

[58] Field of Search ..... 482/57, 60, 62, 79, 482/80, 148, 904

[56] References Cited

U.S. PATENT DOCUMENTS

| | | | |
|---|---|---|---|
| 4,222,376 | 9/1980 | Praprotnik | 482/60 |
| 4,390,177 | 6/1983 | Biran et al. | 482/60 |
| 4,824,132 | 4/1989 | Moore | 482/60 |
| 4,936,573 | 6/1990 | Miller | 482/60 |

*Primary Examiner*—Stephen R. Crow
*Attorney, Agent, or Firm*—Alvin S. Blum

[57] ABSTRACT

An exercise machine includes left and right adjustable resistance exercise mechanisms operated by hand levers linked to pivotal pedals. The machine is positioned before a user seated on a stationary support. To facilitate movement of the machine by a seated user who may be elderly or infirm, a retractable front caster wheel is deployed, elevating the machine off its support posts and onto the front caster wheel and two rear wheels. To stabilize the operating machine against movement when a high resistance is used, retraction of the front caster wheel lowers the machine onto front and rear support posts. Further stability is provided by an anchoring channel which receives the front legs of the user support. A cord attached to front end of the machine connects to the channel and applies tension to anchor the machine against movement. The hand levers are provided with a locking pivotal adjustment to permit the hand grips to be positioned comfortably for the seated user.

9 Claims, 1 Drawing Sheet

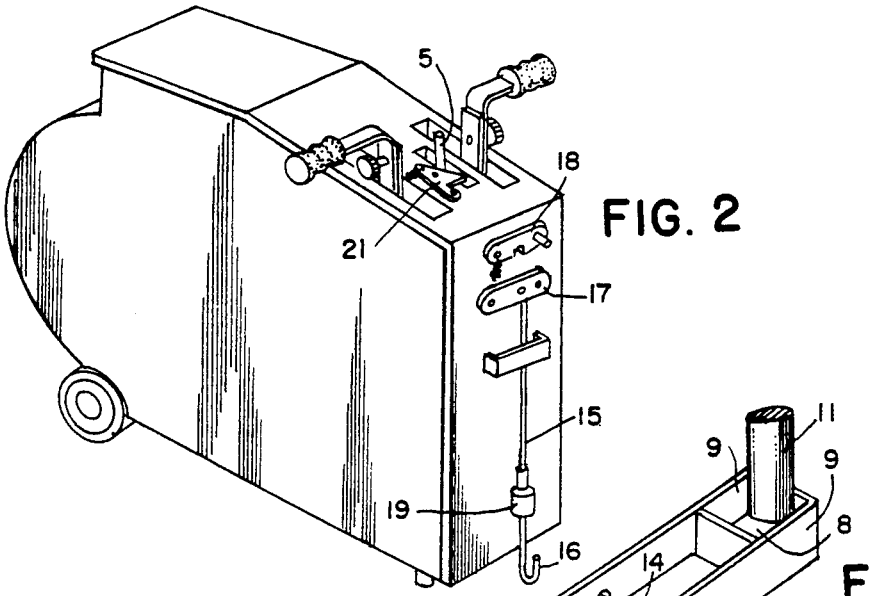
FIG. 2
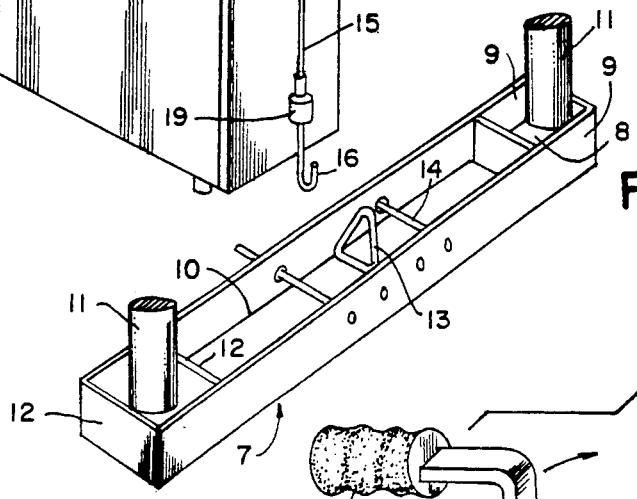
FIG. 3
FIG. 4
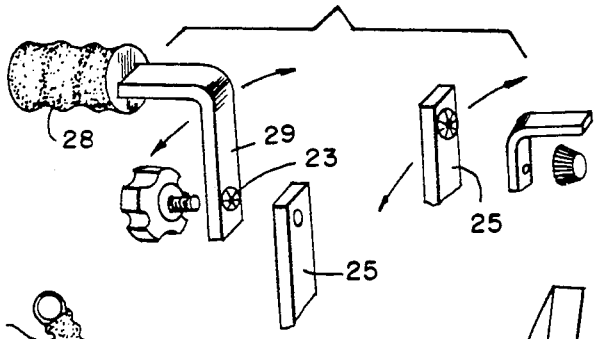
FIG. 1
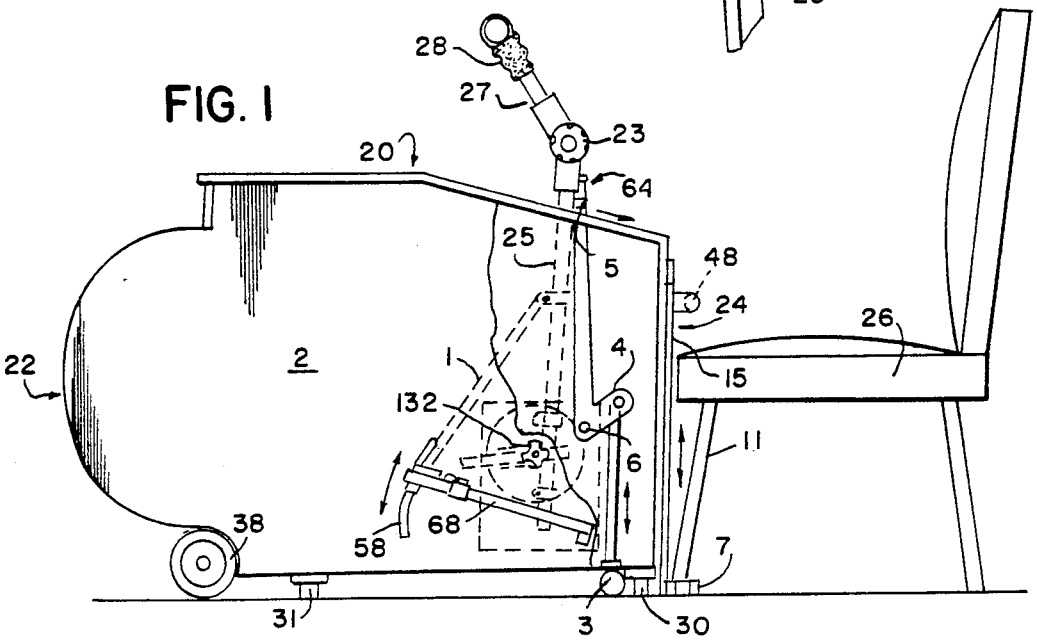

EXERCISE MACHINE FOR SEATED OPERATOR

BACKGROUND OF THE INVENTION

The present invention is directed to exercise machines, and more particularly to exercise machines in which a user moves the machine into position for use while seated, with accessories facilitating the movement and operation from the seated position.

U.S. Pat. No. 4,936,573 issued Jun. 26, 1990 to the applicant discloses an exercise machine for elderly or handicapped people. The disclosure and drawings of that patent are hereby incorporated in this application by reference. It provides separately adjustable left and right side mechanisms. Each side includes a hand operated lever to a movable foot pedal, with an adjustable friction mechanism to vary the resistance to motion. The machine is operated by a user seated before the machine in a chair, on a bed or other suitable seating arrangement. This overcomes problems associated with mounting conventional exercise machines which may be awkward, dangerous, or impossible for certain elderly or incapacitated users. The machine is wheeled to the chair by lifting up one end so that the weight of the machine is borne by a pair of wheels at another end. Then the user is seated and the machine pulled up close enough so that the operator can comfortably rest feet on the pedals. The hand levers are height adjusted for convenient reaching and exercise begins by moving the hand levers back and forth against the adjustable frictional resistance. The height adjustment, alone may not bring the handles close enough for some users.

If the resistance is very great, the back and forth lever motion may move the entire machine back and forth and lift it upward as well.

The machine may be too heavy for a seated user to pull it into proper position for use, especially for a weak or incapacitated operator, without assistance because it does not rest on any wheels when not lifted.

SUMMARY OF THE INVENTION

It is accordingly an object of the invention to provide hand levers with improved adjustability for more comfortable grasping by a user seated in various positions with variable reaching abilities in an exercise machine.

It is another object to provide means for easily maneuvering a heavy exercise machine into position before and by a seated operator while stabilizing that machine against movement after it is so positioned. The machine is provided with a pair of wheels at its rear end, which only engage the floor when the front end is lifted up. When the front end is lowered, a pair of rear legs and a pair of front legs support the machine. Although a standing person can easily lift the front end and wheel it about, this is difficult for the seated user who must bring the machine up close enough for operation. A mobility enhancing device on the front end of enough to tilt the front end up so that the machine is off the legs and supported by the pair of rear wheels and the single caster wheel in front. The machine is then easily rolled into correct position, and the caster wheel then retracted.

To further stabilize the machine against movement, both fore and aft, as well as lifting, when a high resistance is set on the machine, an anchoring system is provided to anchor the machine to the chair. A U-shaped channel with open end uppermost is positioned under the front legs of the chair, so that the weight of chair and occupant hold the channel in place. A cable attached to the front of the machine terminates in a hook which removably engages the channel at a point mid way between the chair legs. It holds the front end of the machine down firmly against any motion when in the locked position.

The hand levers of the machine extend upward from the friction element. They then bend horizontally to terminate in hand grips. The upward extending lever is broken by an adjustable and locking pivot so that the hand grip can be positioned at a most comfortable position for the seated user.

These and other objects, advantages and features of the invention will become more apparent when the detailed description is studied in conjunction with the drawings.

BRIEF DESCRIPTION OF THE DRAWINGS

FIG. 1 is a side elevational view of machine of the invention in operating position anchored to a chair.

FIG. 2 is a perspective view of the front of the machine.

FIG. 3 is a perspective view of the floor channel with chair legs in position.

FIG. 4 is an exploded perspective view of portions of hand levers showing another embodiment of the adjustment mechanism.

DETAILED DESCRIPTION OF PREFERRED EMBODIMENTS

Referring now first to FIG. 1, an exercise machine 20 in accordance with the present invention is shown with a portion of the side wall 2 broken away and certain prior art inner elements removed and others shown in phantom to better reveal the improvements of the invention. The machine 20 rests securely on the floor on a pair of rear support posts 31 and a pair of front support posts 30. It is ordinarily rolled about by lifting front end 24 by handle 48. This lifts the machine off both sets of support posts, putting most of the weight on the pair of wheels 38 at the rear end 22 of the machine. For effective operation, the front end 24 of the machine must be pulled up close to the stationary support chair 26 or bed, while the user is seated, so that the feet can straddle the machine and rest upon the left and right pedals 68 pivotally attached to the sides of the machine. Each pedal 68 is linked to a hand lever 64 by the linkage 1 shown in phantom, with an arcuate slot 58 in side 2 permitting the linkage 1 to move the toe end of the pedal through an arc while lever motion is resisted by adjustable friction mechanism 132 as disclosed in applicant's earlier patent.

It is awkward or impossible for some users to lift the front end by handle 48 while seated. Therefor, they cannot use the machine without assistance. Retractable swivel caster wheel 3 has been installed between left and right hand levers 64. It is linked by linkage mechanism 4 to control lever 5 which pivots about pin 6. When the lever is pulled toward the user, caster wheel 3 is forced downward and the lever 5 is latched in this position by latch 21 seen in FIG. 2. Wheel 3 is down low enough that the machine is lifted completely off support posts 30 and 31. It is supported only by the rear wheels 38 and wheel 3. The machine may now be readily maneuvered into position by a seated user with little effort, at which time layer 5 is unlatched to retract wheel 3 to prevent movement. If the friction adjustment is set for high friction, the forceful fore and aft lever movements may lift the front end 24 of the machine or push the machine back and forth.

As best seen in FIGS. 1-3, a channel 7 is provided to anchor the front end 24 of machine 20 to the floor, to prevent any machine displacement relative to support 26. The channel 7 has a closed bottom web 8, parallel upstanding side walls 9, and an open top 10. The front legs 11 of the chair 26 are inserted through the open top 10 of the channel and rest upon bottom web 8. Transverse partitions 12 may provide a recess for receiving one of the legs.

At a midpoint of the channel, an engaging means in the form of a hook receiving aperture 13 or transverse pin 14 is provided. The front end of the machine is provided with an elongate cord or rod 15 having a hook 16 at its lower end for engaging the engaging means on the channel. The front end of the machine is maneuvered until the hook can be engaged in the channel. Then a lifting mechanism 17 is operated to apply tension on the hook to keep the front end of the machine pulled tightly down onto the channel. A latching mechanism 18 maintains this tension until release. A length adjusting mechanism 19 such as a turnbuckle is provided to adjust the length of cord 15 to a particular situation.

FIG. 1 shows an adjustable hand lever having an adjustable angle pivot assembly 23 connecting a lower lever member 25 with a straight upper lever member 27 whereby the hand grip 28 subtends a plane as it is operated. The upper and lower members may be tubular.

As shown in FIGS. 2 and 4, in an alternative embodiment, the upper lever members, have a hand grip 28 which extends at right angles to the portion 29 pivotally attached to the lower lever, whereby the hand grip 28 subtends a portion of a cylinder as it is operated. The adjustable pivot assembly comprises matching flat gear faces 32 held together by locking screw 33. This structure is well known in the art and is commercially available.

The above disclosed invention has a number of particular features which should preferably be employed in combination although each is useful separately without departure from the scope of the invention. While I have shown and described the preferred embodiments of my invention, it will be understood that the invention may be embodied otherwise than as herein specifically illustrated or described, and that certain changes in the form and arrangement of parts and the specific manner of practicing the invention may be made within the underlying idea or principles of the invention within the scope of the appended claims.

We claim:

1. A movable exercise machine having rear wheels, support posts and a front end, said machine arranged to be positioned before, and operated by a user with said front end toward said user while said user is seated on a stationary support, the improvement comprising:

A) a retractable pivoting wheel mounted on said machine toward said front end, said wheel arranged for lifting said machine free of said support posts when lowered for ease of positioning on three wheels and enabling said machine to be firmly supported only by said support posts when said wheel is retracted, said pivoting wheel arranged to be raised and lowered by said user while seated;

B) a pair of adjustable hand levers, each hand lever comprising an elongate lower lever portion having a lower end connected to a separate friction mechanism and an upper end pivotally connected by adjustable and lockable pivot means to an upper lever portion, said upper lever portion terminating in a hand grip means for comfortable grasping by a user, said pivot means enabling said grip means to be adjusted through an arc about said pivot means for enhanced operation by a seated user;

C) an elongate floor channel means having a closed bottom web and an open top adapted to receive, when resting on a floor, parallel legs of a support on which a user is seated to thereby anchor said channel means by weight of said support and said user, said channel means provided, at a point substantially midway between said parallel legs, with engaging means;

D) an elongate member connected at an upper end to the front of said machine and at a lower end to a channel engaging element, said channel engaging element arranged for removably engaging said engaging means on said channel means; and E) a lifting mechanism on said machine connected to said upper end of said elongate member, said lifting mechanism arranged to apply tension on said elongate member when said channel engaging means is engaging said channel means to thereby prevent movement of said machine when operated by said seated user.

2. The machine according to claim 1, further comprising length adjusting means on said elongate member for adjusting said machine for enhanced operation with a particular support and user.

3. The machine according to claim 2, in which said channel engaging element includes a hook.

4. The machine according to claim 3, in which said channel means includes parallel walls upstanding from said bottom web and said engaging means includes a pin passed through both said upstanding walls.

5. The machine according to claim 3, in which said engaging means includes an eye element for receiving said hook.

6. The machine according to claim 3, in which said lifting mechanism is provided with latch means to maintain said tension when said elongate member is lifted.

7. The machine according to claim 6, in which said retractable wheel is provided with a latching means for maintaining said wheel in a lowered position.

8. The machine according to claim 7, in which said upper lever portion comprises a first end connected to said pivot means and a second end extending orthogonally from said first end and terminating in said grip means.

9. The machine according to claim 3, further comprising a pair of movable pedals pivotally attached to said machine, each one of said pair of pedals being coupled to one of said handle levers, whereby motion of said lever causes motion of said pedal for exercising both arm and foot.

* * * * *